US007243715B2

(12) United States Patent
Wang et al.

(10) Patent No.: US 7,243,715 B2
(45) Date of Patent: Jul. 17, 2007

(54) MESH SCREEN APPARATUS AND METHOD OF MANUFACTURE

(75) Inventors: David Wei Wang, Manvel, TX (US); Colin J. Price-Smith, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 193 days.

(21) Appl. No.: 10/626,916

(22) Filed: Jul. 25, 2003

(65) Prior Publication Data

US 2004/0084177 A1 May 6, 2004

Related U.S. Application Data

(60) Provisional application No. 60/399,254, filed on Jul. 29, 2002.

(51) Int. Cl.
*E21B 43/08* (2006.01)
*E03B 3/18* (2006.01)

(52) U.S. Cl. ..... 166/230; 166/276; 166/278; 210/499

(58) Field of Classification Search ..... 166/230, 166/228, 233, 227, 278, 276, 234; 210/348, 210/494.2, 497.01, 499
See application file for complete search history.

(56) References Cited

U.S. PATENT DOCUMENTS 2,217,370 A 10/1940 Johnston
2,877,852 A * 3/1959 Bashara ..... 166/236
2,911,101 A * 11/1959 Robinson ..... 210/458
3,353,682 A * 11/1967 Pall et al. ..... 210/505
3,871,411 A * 3/1975 Sato et al. ..... 138/178
4,052,316 A * 10/1977 Berger et al. ..... 210/315
4,250,172 A * 2/1981 Mutzenberg et al. ..... 442/6
4,613,369 A * 9/1986 Koehler ..... 75/246
4,696,751 A * 9/1987 Eifling ..... 210/780
5,293,935 A * 3/1994 Arterbury et al. ..... 166/228
5,419,953 A * 5/1995 Chapman ..... 442/35
5,611,399 A * 3/1997 Richard et al. ..... 166/230
5,664,628 A * 9/1997 Koehler et al. ..... 166/369
5,711,879 A 1/1998 Carlson
5,782,299 A * 7/1998 Simone et al. ..... 166/230
5,833,853 A 11/1998 Carlson
6,004,639 A * 12/1999 Quigley et al. ..... 428/36.3
6,006,829 A * 12/1999 Whitlock et al. ..... 166/228
6,065,535 A * 5/2000 Ross ..... 166/51
6,237,780 B1 * 5/2001 Schulte ..... 210/388
6,382,318 B1 * 5/2002 Whitlock ..... 166/278
6,457,518 B1 * 10/2002 Castano-Mears et al. ... 166/207
6,554,065 B2 * 4/2003 Fisher et al. ..... 166/253.1
6,684,951 B2 * 2/2004 Restarick et al. ..... 166/250.01
2002/0007948 A1 * 1/2002 Bayne et al. ..... 166/278
2003/0173075 A1 * 9/2003 Morvant et al. ..... 166/230

FOREIGN PATENT DOCUMENTS

GB 1593338 A 7/1981

* cited by examiner

*Primary Examiner*—Jennifer H. Gay
(74) *Attorney, Agent, or Firm*—Van Somern, PC; Bryan P. Galloway; Jaime A. Castano

(57) ABSTRACT

The present invention provides for a design and method of manufacture for a mesh-type screen to be used in subsurface well completions to prevent the production of sand.

14 Claims, 1 Drawing Sheet

MESH SCREEN APPARATUS AND METHOD OF MANUFACTURE

This application claims the benefit of U.S. Provisional Application 60/399,254 filed Jul. 29, 2002.

BACKGROUND

1. Field of Invention

The present invention pertains to screens used in subsurface well completions, and particularly to screens using mesh media.

2. Related Art

Screens are commonly used in well completions in which the producing formation is poorly or loosely consolidated. Abrasive particulates, generally referred to as "sand" or "fines", can cause problems if produced. For example, the formation surrounding the wellbore can erode and wash out, potentially leading to collapse of the well. Sand can damage equipment such as pumps or seals as the sand travels at high speed through the pump or past the seals. Produced sand must be disposed of, and this imposes an additional cost to the well operator. Fines can clog flow passages, disrupting production.

Often, to enhance filtration, a layer of particles of pre-sorted size, commonly referred to as "gravel", is injected between the formation (or casing) and the screen. In those cases, the screen is sized to prevent passage of the gravel. The gravel in turn prevents the passage of fines.

Various screen types are used to prevent the production of sand. For example, a perforated base pipe can have wire wrapped around it such that the spacing between the wire wraps limits the size of sand that can pass. Mesh material can also be used. However, manufacturing screens can be an expensive, time-consuming undertaking. Therefore, there is a continuing need for improved designs and manufacturing methods for screens.

SUMMARY

The present invention provides for a design and method of manufacture for a mesh-type screen to be used in subsurface well completions to prevent the production of sand.

Advantages and other features of the invention will become apparent from the following description, drawings, and claims.

DETAILED DESCRIPTION

Figure 1:
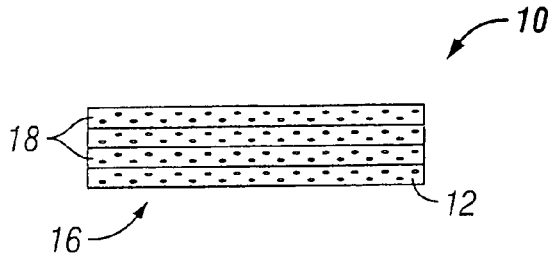
FIG. 1 is a schematic view of a mesh screen apparatus constructed in accordance with the present invention.
Figure 2:
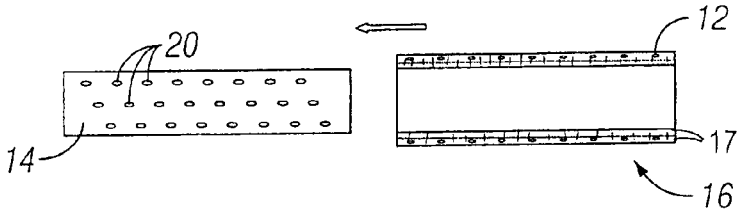
FIG. 2 is an exploded view of the mesh screen apparatus of FIG. 1.

FIG. 1 shows a mesh screen apparatus 10 constructed in accordance with the present invention. Mesh screen apparatus 10 comprises a mesh medium 12 and a perforated base pipe 14 (FIG. 2). Mesh medium 12 comprises fiber strands 16, preferably made of metal. In one embodiment, fibers 16 are intermeshed in orthogonal directions to form a layer 17, and multiple layers 17 are then stacked upon each other, as illustrated in FIG. 2. If multiple layers are used, preferably the layers are interlocked.

A method of producing such an interlocking, layered embodiment of mesh medium 12 is to use needles to punch through the stacked layers of fibers 16. Needles having prongs can be pushed back and forth through the layers, interlocking fibers 16 from different layers. As illustrated in FIG. 2, individual fibers 16 from each layer 17 are pushed into adjacent layers 17. If desired, the resulting blanket of mesh medium 12 can then be formed into a seamless tube, as shown in FIG. 1.

Using needles to interlace fibers 16 to make mesh medium 12 allows various porosities in mesh medium 12 to be produced. Porosities commonly range between thirty and ninety-two percent, though other porosities are possible. Fibers 16 of different diameters can also be used to vary porosity. Fiber diameters ranging from two to two hundred microns are commonly used, though the present invention is not limited to those diameter fibers. In this embodiment, as before, fibers 16 preferably interlock among layers. Larger diameter fibers 16 allow for larger porosities. Various diameter fibers 16 can be used in the same mesh medium 12 to produce a mesh medium 12 having variable porosity.

The thickness of mesh medium 12 generally ranges from 0.125 inches to 0.25 inches, but is not limited to that range. Optionally, to make the mesh medium 12 more resistant to collapse, one or more pieces of standard mesh 18 can be placed between certain layers of mesh medium 12, as shown in FIG. 1.

Figure 3:
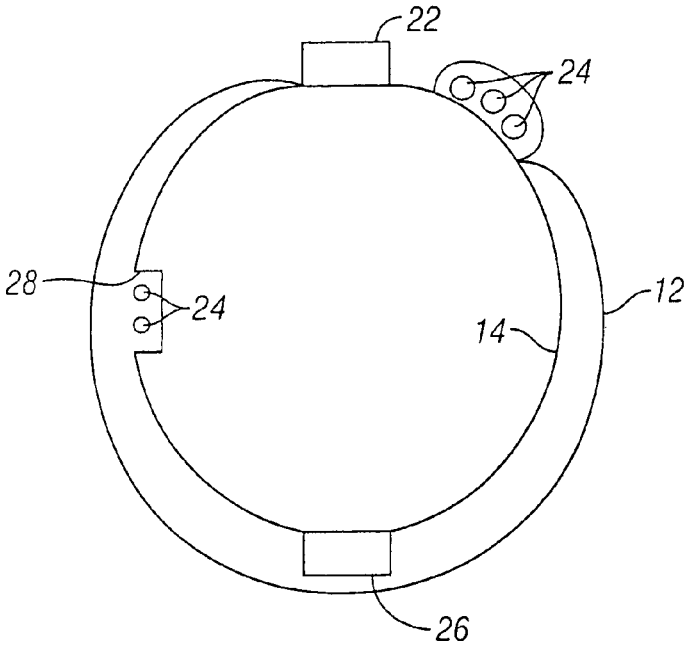
FIG. 3 is a schematic view of an alternate embodiment of a mesh screen apparatus constructed in accordance with the present invention.

In the embodiment shown in FIG. 3, mesh screen apparatus 10 surrounds only a portion of base pipe 14. The ends of mesh medium 12 may be secured directly to base pipe 14, or otherwise secured to cover openings 20 (FIG. 1) in base pipe 14. The partial covering is to accommodate other structures such as transport tubes 22 or control lines 24 running longitudinally along base pipe 14. Transport tubes 22 are used to provide alternate paths for fluid used in treatments such as gravel packing, fracturing, or acidizing. Examples of control lines 24 include electrical, hydraulic, fiber optic, and combinations thereof.

Note that the communication provided by the control lines 24 may be with downhole controllers rather than with the surface, and the telemetry may include wireless devices and other telemetry devices such as inductive couplers and acoustic devices. In addition, control line 24 itself may comprise an intelligent completion device as in the example of a fiber optic line that provides functionality, such as temperature measurement, pressure measurement, and the like. In one example, the fiber optic line provides a distributed temperature functionality so that the temperature along the length of the fiber optic line may be determined.

The embodiment of FIG. 3 also includes intelligent completion devices 26 such as gauges, sensors, valves, sampling devices, a device used in intelligent or smart well completion, temperature sensors, pressure sensors, flow-control devices, flow rate measurement devices, oil/water/gas ratio measurement devices, scale detectors, actuators, locks, release mechanisms, equipment sensors (e.g., vibration sensors), sand detection sensors, water detection sensors, data recorders, viscosity sensors, density sensors, bubble point sensors, pH meters, multiphase flow meters, acoustic sand detectors, solid detectors, composition sensors, resistivity array devices and sensors, acoustic devices and sensors, other telemetry devices, near-infrared sensors, gamma ray detectors, Hydrogen sulfide ($H_2S$) detectors, carbon dioxide ($CO_2$) detectors, downhole memory units, downhole controllers, perforating devices, shape charges, firing heads, locators, and other downhole devices. In addition, control line 24 may comprise an intelligent completions device 26 as in the example of the fiber optic line that provides functionality, such as temperature measurement, pressure measurement, and the like. In one example, the fiber optic line provides a distributed temperature functionality so that the temperature along the length of the fiber optic line may be determined.

A base pipe 14 having structures attached thereto can also have mesh medium 12 placed such that mesh medium 12 encloses both base pipe 14 and the attached structures.

Figure 4:
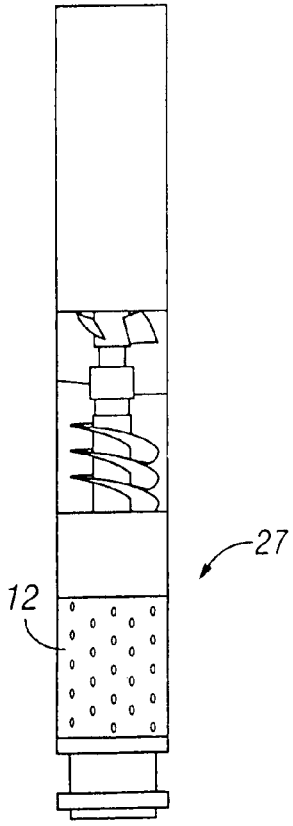
FIG. 4 is a schematic view of an alternate embodiment of a mesh screen apparatus constructed in accordance with the present invention.

Mesh medium 12 can also be used to wrap and protect a piece of equipment, such as an electrical submersible pump 27 (see FIG. 4). Mesh medium 12 can partially or completely enclosed pump 27.

A method of manufacture of mesh screen apparatus 10 as contemplated under this invention is to slide a pre-fabricated tubular form of mesh medium 12, produced as described above, over base pipe 14, as indicated by the arrow in FIG. 2. Base pipe 14 is a conventional tubing having openings 20 such as perforations or slots, as is well known in the art. Base pipe 14 can have an inset portion 28 (FIG. 3) to accommodate transport tubes 22 or control lines 24.

Although only a few example embodiments of the present invention are described in detail above, those skilled in the art will readily appreciate that many modifications are possible in the example embodiments without materially departing from the novel teachings and advantages of this invention. Accordingly, all such modifications are intended to be included within the scope of this invention as defined in the following claims. It is the express intention of the applicant not to invoke 35 U.S.C. § 112, paragraph 6 for any limitations of any of the claims herein, except for those in which the claim expressly uses the words 'means for' together with an associated function.

We claim:

1. A mesh screen apparatus used in subterranean wells, comprising:

a mesh medium having interlocking layers of mesh material, the interlocking layers being connected by fibers extending from an individual interlocking layer into the next adjacent interlocking layer; and a base pipe having openings in its sidewall, and onto which the mesh medium is mounted such that the mesh medium covers the openings.

2. The mesh screen apparatus of claim 1 in which the mesh material comprises fiber strands.

3. The mesh screen apparatus of claim 2 in which the fiber strands are arranged in orthogonal layers.

4. The mesh screen apparatus of claim 2 in which the fiber strands are metallic.

5. The mesh screen apparatus of claim 1 in which the mesh medium is a tubular.

6. The mesh screen apparatus of claim 5 in which the tubular is seamless.

7. The mesh screen apparatus of claim 1 in which the mesh medium has a porosity.

8. The mesh screen apparatus of claim 7 in which the mesh material comprises fiber strands and the porosity is determined by the thickness of the fiber strands.

9. The mesh screen apparatus of claim 7 in which the mesh material comprises fiber strands of variable diameter and the porosity is variable across the mesh medium.

10. The mesh screen apparatus of claim 7 in which the mesh material comprises fiber strands and the porosity is determined by the diameter and number of openings in the mesh medium.

11. The mesh screen apparatus of claim 1, further comprising a structure positioned along the base pipe, the mesh medium covering the structure.

12. The mesh screen apparatus of claim 1 in which the mesh medium covers only a circumferential portion of the base pipe, the mesh medium having ends secured directly to the base pipe.

13. The mesh screen apparatus of claim 1 in which the mesh medium covers only a circumferential portion of the base pipe.

14. A mesh screen apparatus used in subterranean wells, comprising:

a mesh medium having a plurality of separate layers of mesh material, the plurality of separate layers of mesh material being interlocked by fibers extending from at least one layer of mesh material into an adjacent layer of mesh material; and a piece of equipment having at least one intelligent completion device which the mesh medium at least partially encloses such that the mesh medium prevents infiltration of particulates into the equipment.

* * * * *